US011012782B2

(12) United States Patent
D'Ascanio et al.

(10) Patent No.: US 11,012,782 B2
(45) Date of Patent: May 18, 2021

(54) RADIAL DOME SPEAKER

(71) Applicants: Franco L D'Ascanio, Key Colony Beach, FL (US); Franco C D'Ascanio, Key Colony Beach, FL (US); Sean P Snowden, Marathon, FL (US)

(72) Inventors: Franco L D'Ascanio, Key Colony Beach, FL (US); Franco C D'Ascanio, Key Colony Beach, FL (US); Sean P Snowden, Marathon, FL (US)

( * ) Notice: Subject to any disclaimer, the term of this patent is extended or adjusted under 35 U.S.C. 154(b) by 0 days.

(21) Appl. No.: 16/876,221

(22) Filed: May 18, 2020

(65) Prior Publication Data

US 2020/0366995 A1 Nov. 19, 2020

Related U.S. Application Data

(60) Provisional application No. 62/848,741, filed on May 16, 2019.

(51) Int. Cl.
*H04R 7/12* (2006.01)
*H04R 9/06* (2006.01)

(52) U.S. Cl.
CPC ..... *H04R 7/127* (2013.01); *H04R 9/06* (2013.01)

(58) Field of Classification Search
CPC ..... H04R 7/127
See application file for complete search history.

(56) References Cited

U.S. PATENT DOCUMENTS 4,949,386 A * 8/1990 Hill ..... H04R 1/026 181/149
9,743,178 B2 * 8/2017 Chou ..... H04R 1/24

* cited by examiner

*Primary Examiner* — Andrew L Sniezek
(74) *Attorney, Agent, or Firm* — Stuart M. Goldstein

(57) ABSTRACT

A radial dome speaker is provided which emits sound up and out from low or no profile speakers, resulting in clear and true acoustics and allows direct driver exposure to the elements regardless of its orientation. The speaker is specially configured with a radial surround element which allows for self-cleaning and self-draining, even in outdoor environments.

7 Claims, 6 Drawing Sheets

RADIAL DOME SPEAKER

RELATED APPLICATION

The application claims the benefit of provisional application 62/848,741, filed on May 16, 2019.

FIELD OF THE INVENTION

The present invention relates to outdoor self-draining/self-cleaning, high performance acoustical dome speakers.

BACKGROUND OF THE INVENTION

A minimal visual profile and footprint is the objective in the design and ultimate installation of outdoor dome speakers. However, decreasing the profile of the speaker lowers and reduces the psychoacoustic sound stage, imparting a sense of artificial and inaccurate sound. The challenge then, which has not been addressed by prior speakers or speaker systems, is to design an outdoor dome speaker which not only enjoys a low or no profile, but, significantly, provides clear and undistorted sound.

Of equal importance, since outdoor speakers are continually exposed to weather, the quality of their performance deteriorates. None of the present day, conventional speaker drivers can be used for outdoor speakers which have drivers facing even slightly upwards from a horizontal position. Current speakers have drivers which are hidden inside enclosures facing downwards or they have intricate covers with acoustic channels to direct sound outwards. All this negatively affects sound quality and prevents direct radiation. In addition, in outdoor environments, up-facing cone drivers and even traditional dome drivers collect water and, in freezing conditions, ice, in addition to ambient dirt and debris. This damages the drivers both acoustically and mechanically.

SUMMARY OF THE INVENTION

It is thus the object of the present invention to address and overcome the limitations and disadvantages of existing outdoor speakers. This and other objects are accomplished by the present invention, an outdoor, radial dome speaker which emits sound up and out from low or no profile speakers, resulting in clear and true acoustics and allows direct driver exposure to the elements regardless of its orientation. The speaker is specially configured with a radial surround element which allows for self-cleaning and self-draining, even in outdoor environments.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
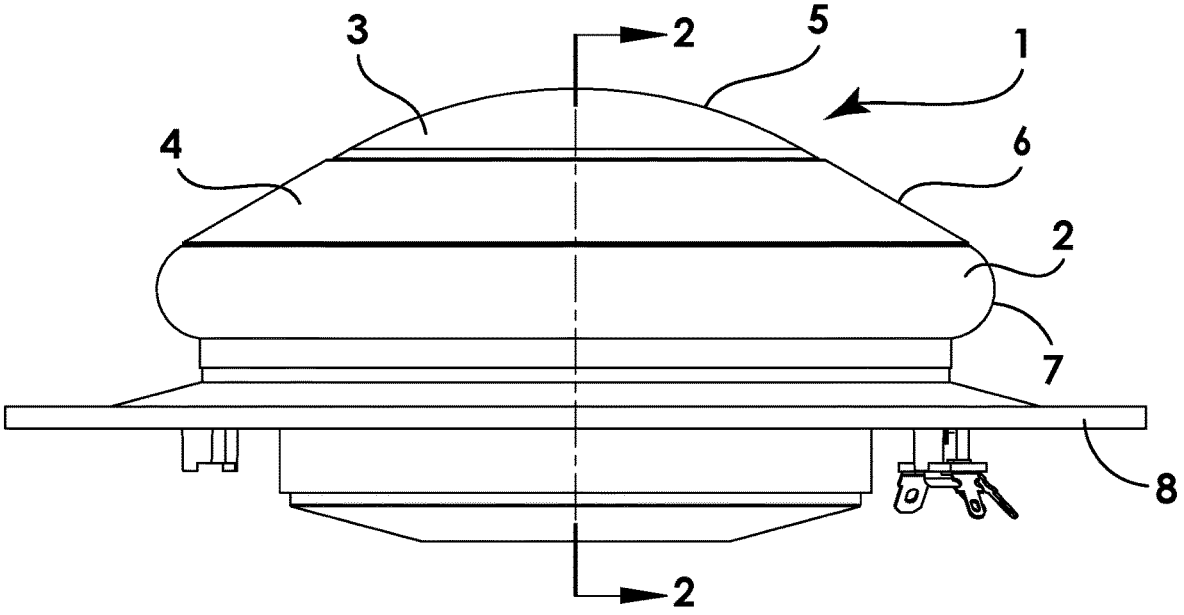
FIG. 1 is an elevation view of the dome speaker of the present invention.
Figure 2:
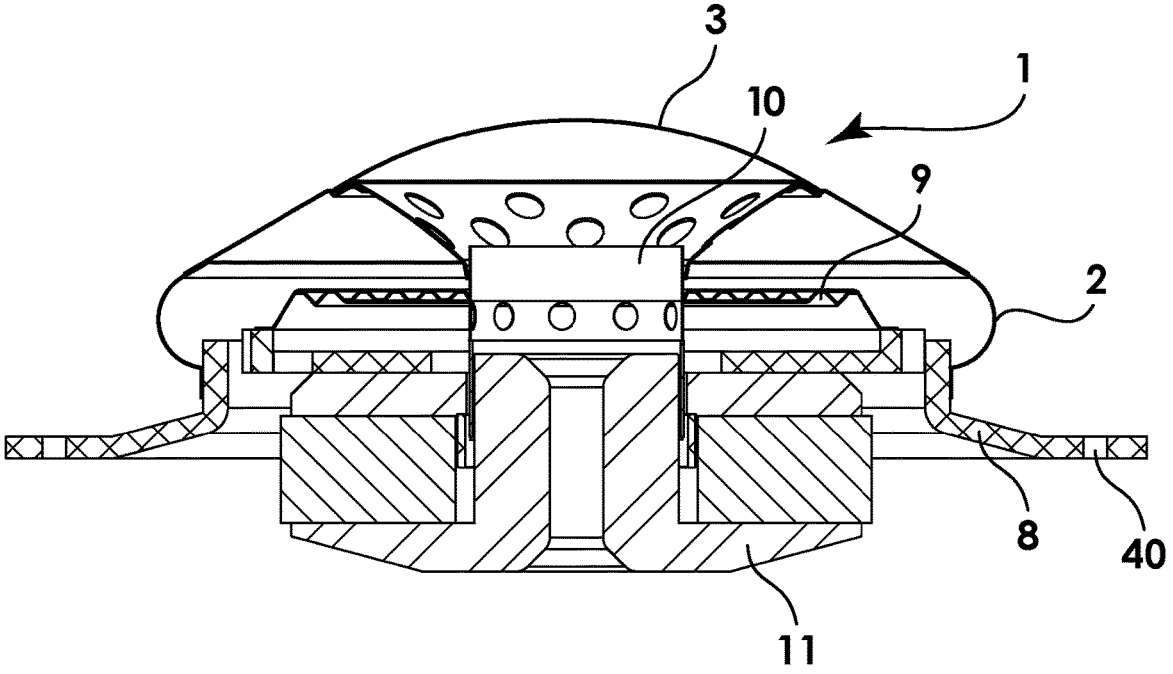
FIG. 2 is a section view of the dome speaker of the present invention taken from FIG. 1.
Figure 4:
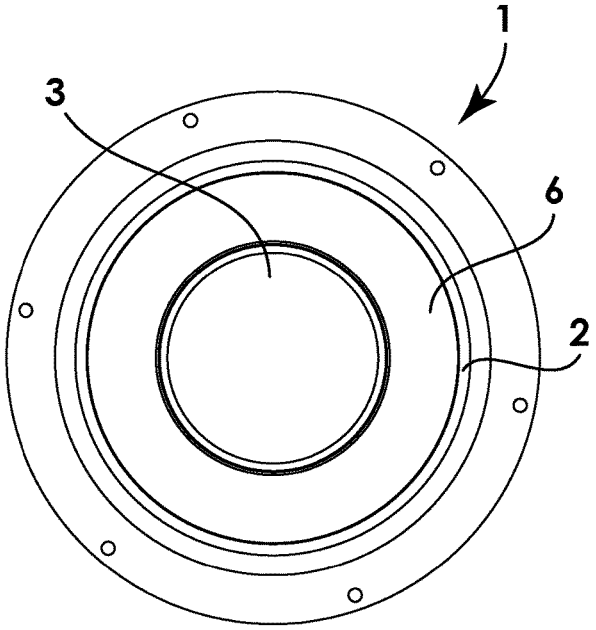
FIG. 4 is a top view of the dome speaker of the present invention.
Figure 3:
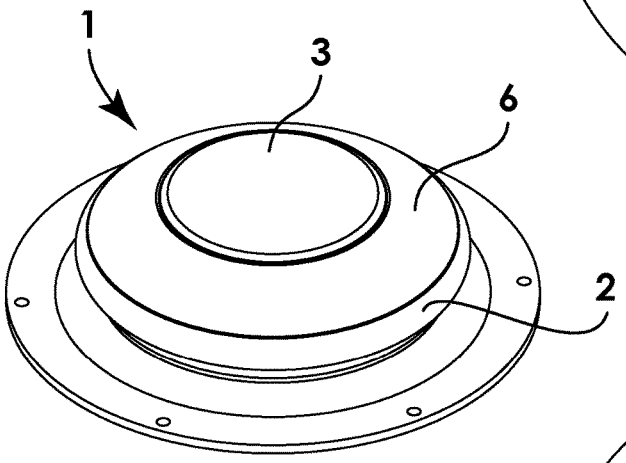
FIG. 3 is a top perspective view of the dome speaker of the present invention.
Figure 6:
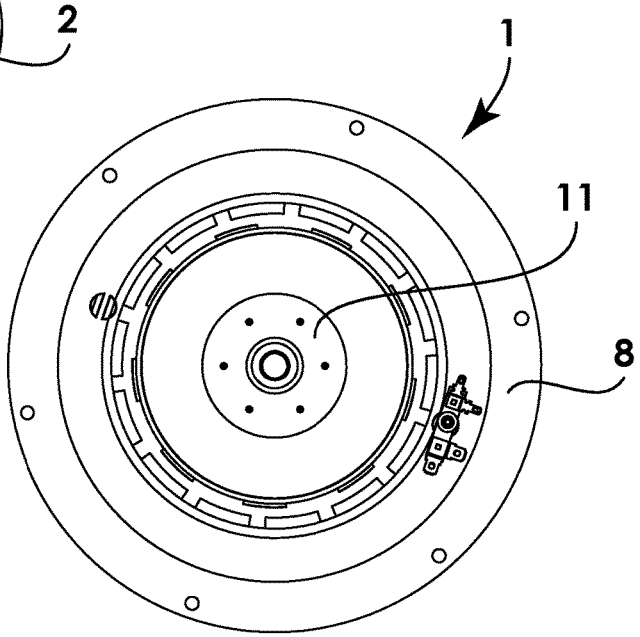
FIG. 6 is a bottom view of the dome speaker of the present invention.
Figure 5:
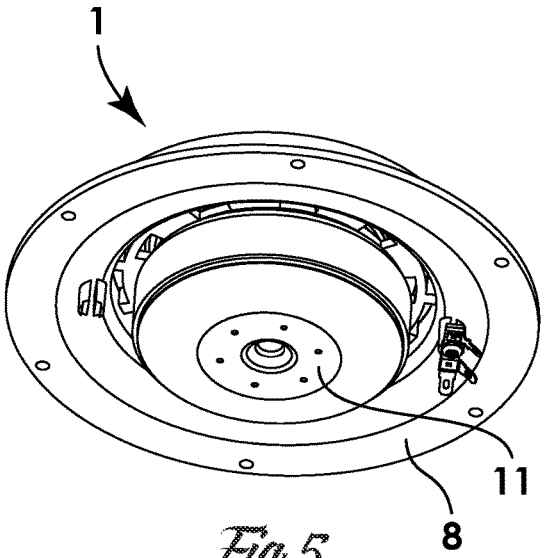
FIG. 5 is a bottom perspective view of the dome speaker of the present invention.
Figure 7:
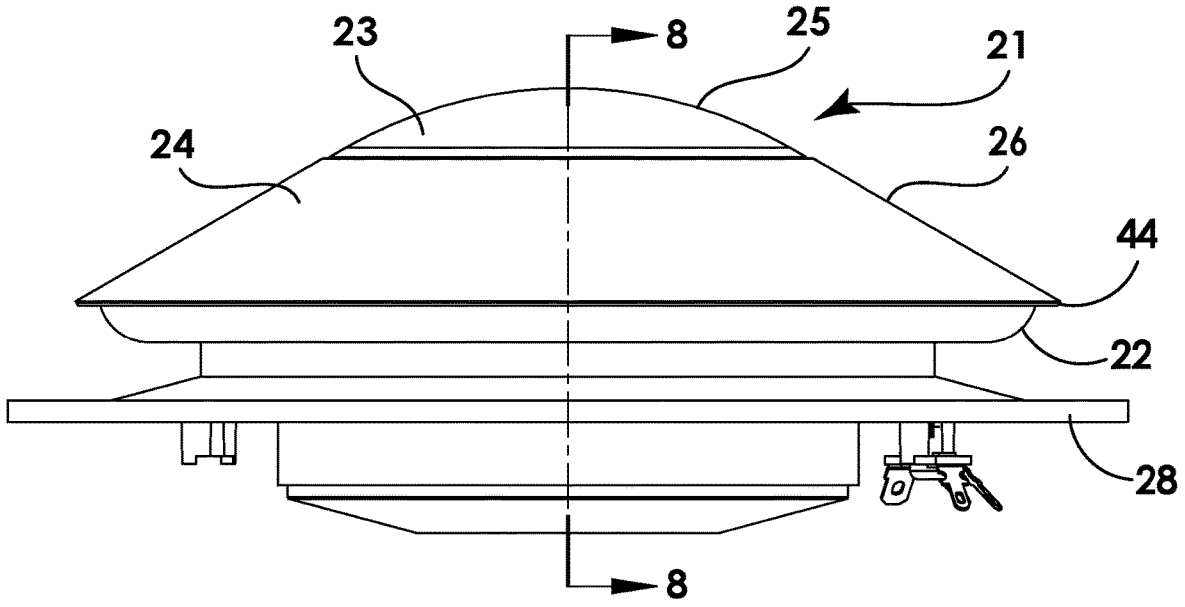
FIG. 7 is an elevation view of a second embodiment of the dome speaker of the present invention.
Figure 8:
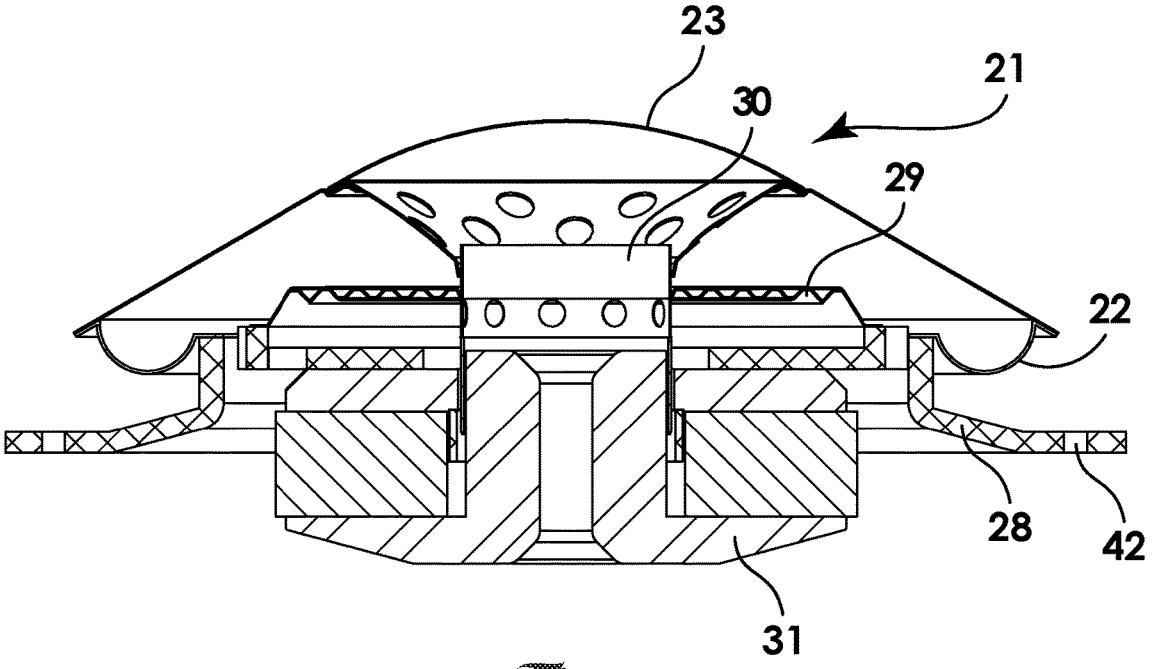
FIG. 8 is a section view of the dome speaker of the present invention taking from FIG. 7.
Figure 10:
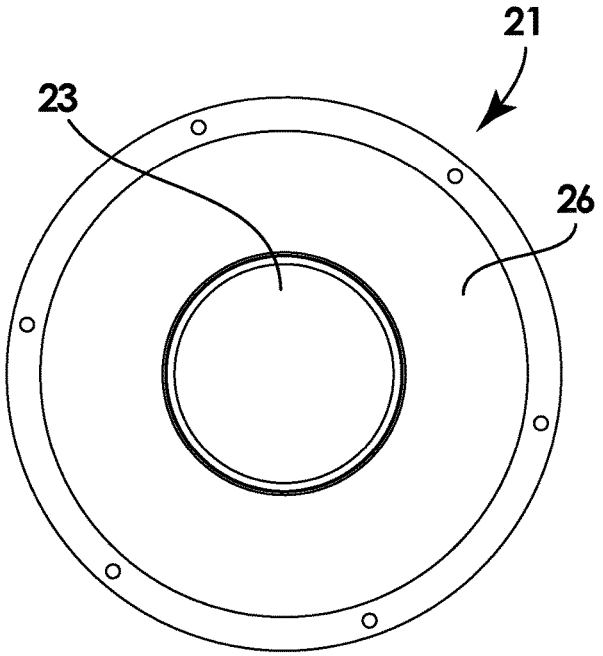
FIG. 10 is a top view of the second embodiment of the dome speaker of the present invention.
Figure 9:
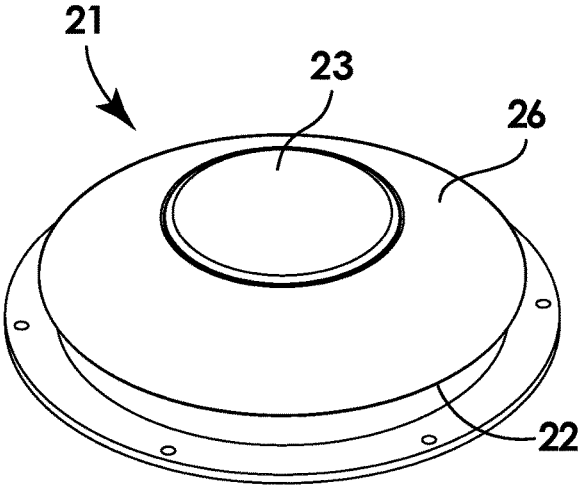
FIG. 9 is a top perspective view of the second embodiment of the dome speaker of the present invention.
Figure 12:
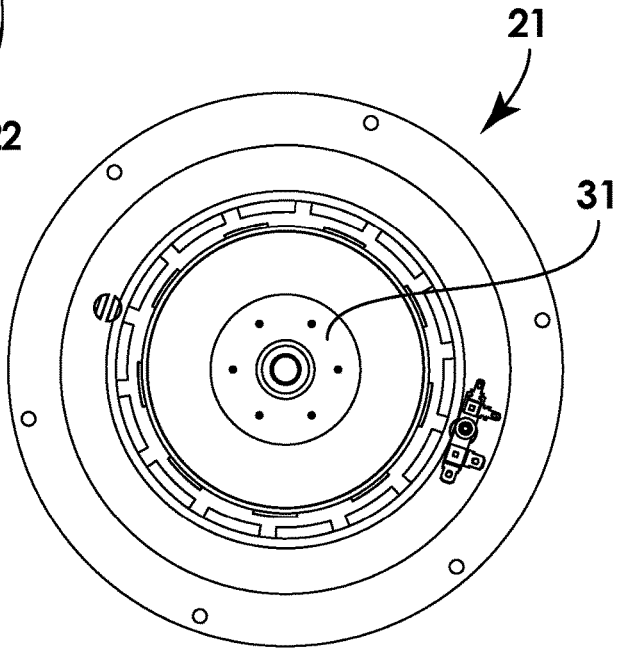
FIG. 12 is a bottom view of the dome speaker of the present invention.
Figure 11:
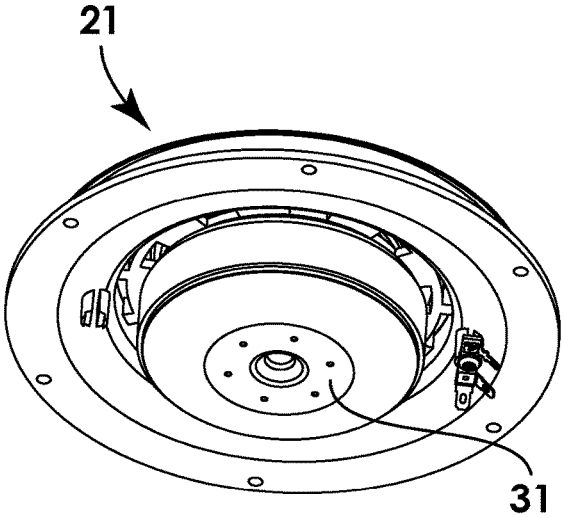
FIG. 11 is a bottom perspective view of the dome speaker of the present invention.
Figure 13:
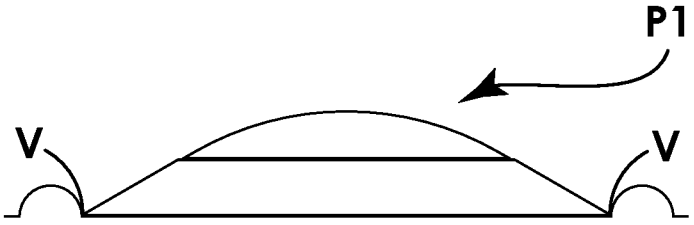
Fig.13 PRIOR ART
FIG. 13 is a partial elevation view of prior art depicting a commonly known dome speaker configuration.
Figure 14:
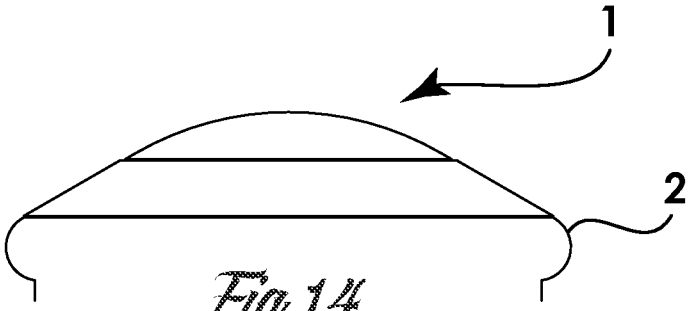
FIG. 14 is a partial elevation view of the first embodiment of the dome speaker of the present invention, in comparison to the commonly known speaker configuration shown in FIG. 13.
Figure 15:
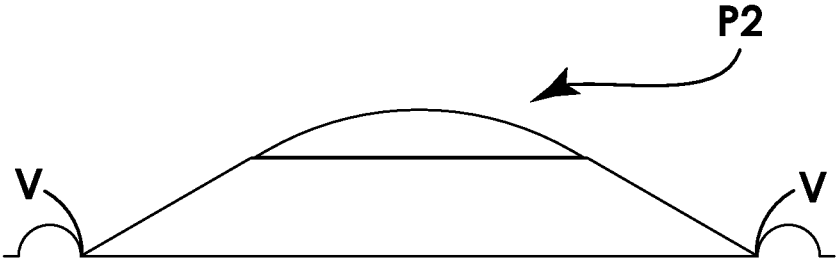
Fig.15 PRIOR ART
FIG. 15 is a partial elevation view of prior art depicting another commonly known dome speaker configuration.
Figure 16:
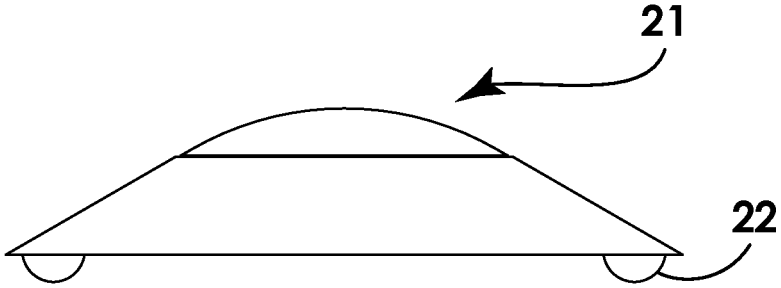
FIG. 16 is a partial elevation view of the second embodiment of the dome speaker of the present invention, in comparison to the commonly known speaker configuration shown in FIG. 15.

Radial dome speaker 1 of the present invention comprises a proprietary, curved, "C" shaped radial surround element 2 attached to upper speaker diaphragm 3 via lower speaker diaphragm 4. Upper diaphragm 3 is positioned atop speaker 1 and has smooth, curved side wall surfaces 5 which slope downward, terminating at lower diaphragm 4. The diaphragms are preferably domed shaped, but a conical or other shell shape diaphragm which has sloped surfaces that do not accumulate water and debris may be used. The diaphragms are fabricated of material that withstands outdoor elements and ensures long-term operation of speaker 1. Anodized aluminum or like material can be used.

Lower diaphragm 4 also has smooth, curved side wall surfaces 6, and these surfaces are contiguous with side wall surfaces 5 of upper diaphragm 3. Side wall surfaces 6 slope downward to radial surround element 2, which is located below and completely circumscribes the bottom of lower diaphragm 4. Radial surround element 2 has outer surfaces 7 which are vertically oriented and contiguous with side wall surfaces 6 of lower diaphragm 4.

A lower edge of radial surround element 2 is attached to frame 8. Suspension spider 9 is attached to frame 8 along its external edge and to voice coil 10 with its internal edge. Mounting holes 40 are provided for securing frame 8. Magnet system 11 is positioned below voice coil 10. When an electrical signal is supplied to the voice coil 10 it starts moving in and out of magnet system 11, translating vibrations to the diaphragms.

A novel feature of the invention is that the design allows water, dirt, and debris to roll off the diaphragms in a static mode. In an active mode (reproducing sound), vibration and motion of the diaphragms and radial surround element 2 facilitates a self-cleaning process by energizing particles that accumulate on their surfaces.

A second embodiment of the invention comprises radial dome speaker 21 in which radial surround element 22 is rotated from vertical position inwards relative to upper speaker diaphragm 23 so that it is positioned predominantly horizontally with its convex shape facing downwards. Radial surround element 22 should preferably be of a "U" or circular shape, but other convex shapes are possible that provide linear compliance in a large range of motion and do not allow water or debris accumulation. Radial surround element 22 is located below and circumscribes the bottom of lower speaker diaphragm 24.

Radial surround element 22 is attached to upper diaphragm 23 via lower diaphragm 24. Upper diaphragm 23 is positioned atop speaker 21 and has smooth, curved side wall surfaces 25 which slope downward, terminating at lower diaphragm 24. Like the first embodiment of the invention, the diaphragms are preferably domed shaped, but a conical or other shell shape diaphragm which has sloped surfaces that do not accumulate water and debris may be used. The diaphragms are fabricated of material that withstands outdoor elements and ensures long-term operation of speaker 21. Anodized aluminum or like material can be used.

Lower diaphragm 24 also has smooth, curved side wall surfaces 26, and these surfaces are contiguous with side wall surfaces 25 of upper diaphragm 23. Side wall surfaces 26 slope downward to and extend beyond radial surround element 22, terminating at bottom edge 44. Radial surround element 22 completely circumscribes the bottom of lower diaphragm 24.

Radial surround element 22 is attached at its inboard side to frame 28. Suspension spider 29 is attached to frame 28 along its external edge and to voice coil 30 with its internal edge. Mounting holes 42 are provided for securing frame 28. Magnet system 31 is positioned below voice coil 30. When an electrical signal is supplied to the voice coil 30 it starts moving in and out of magnet system 31, translating vibrations to the diaphragms.

Water, dirt, and debris rolls off the diaphragms in a static mode. In an active mode (reproducing sound), vibration and motion of the diaphragms and radial surround element 22 facilitates a self-cleaning process by energizing particles that accumulate on their surfaces.

Another advantage of the present invention is that it allows maximization of radiating area of the diaphragms 3, 4 and 23, 24 within given external diameter of frames 8 and 28. Conventional drivers have the surrounds attached to the external perimeter of their diaphragms and then extend radially further outside. Furthermore, the surround's external edge requires an additional frame flange portion for attachment. This results in a large "passive" area outside of the diaphragm.

In the present invention radial surround elements 2 and 22 either do not protrude much (i.e. radial surround 2) or not at all (i.e. radial surround 22) beyond the diaphragm 3, 4 and 23, 24 perimeters. This allows using a diaphragm with maximum possible diameter (for a given frame size), increasing its area by up to 20% versus conventional designs, resulting in maximized driver acoustic output.

While the embodiments described herein provide for upper and lower diaphragms, it is contemplated that one single unitary diaphragm can be used.

FIGS. 13 and 14, and FIGS. 15 and 16 compare the unique designs of the two embodiments of the invention to current radial surround systems. It is evident that even speakers P1 and P2 with common dome diaphragms have surround elements which form V-shaped radial valleys V, where they join their respective diaphragms. This results in accumulations of water, dirt, and debris in these areas.

Figure 17:
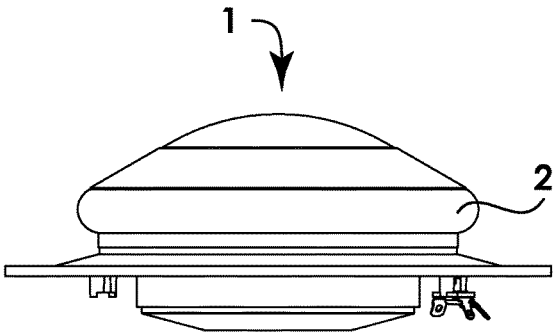
FIG. 17 depicts the dome speaker of the present invention in its static mode.
Figure 18:
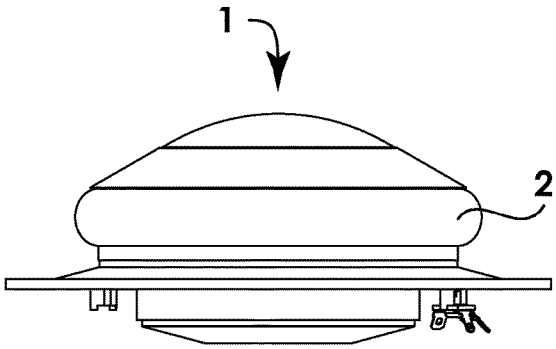
FIG. 18 depicts the dome speaker of the present invention in its fully extended active mode.
Figure 19:
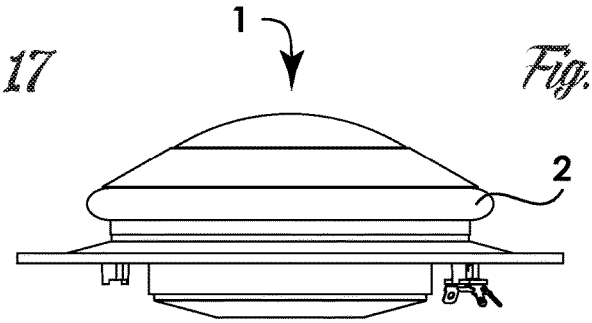
FIG. 19 depicts the dome speaker of the present invention in its active, fully retracted mode.
Figure 20:
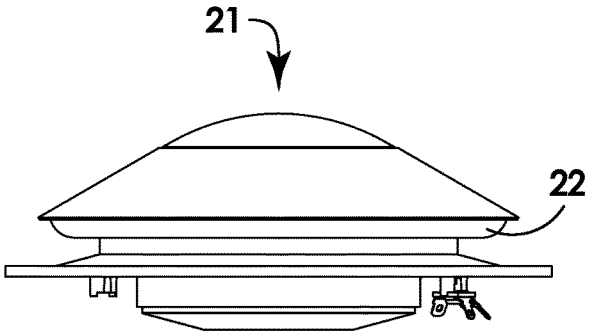
FIG. 20 depicts the second embodiment of the dome speaker of the present invention and its static mode.
Figure 21:
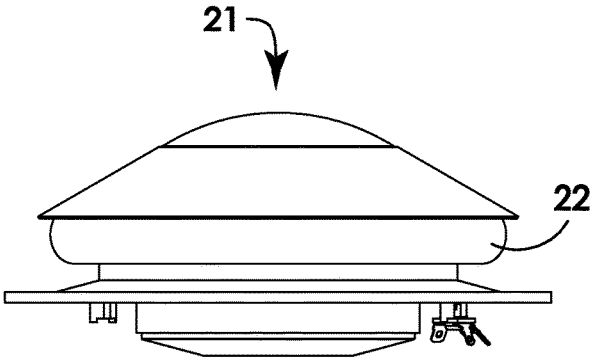
FIG. 21 depicts the second embodiment of the dome speaker of the present invention in its fully extended, active mode.
Figure 22:
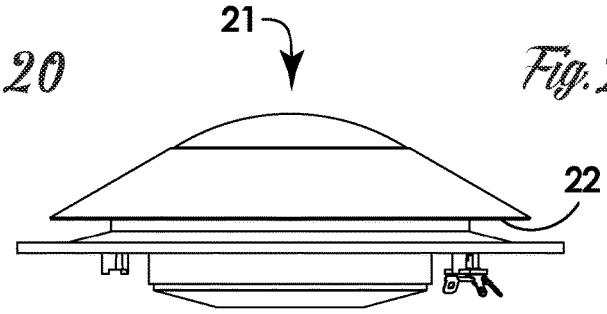
FIG. 22 depicts the second embodiment of the dome speaker of the present invention in its fully retracted, active mode.

FIGS. 17 and 20 show the two embodiments of the invention, speakers 1 and 21, in their static modes. FIGS. 18 and 21 show speakers 1 and 21 in their fully extended, active, sound producing modes. FIGS. 19 and 22 show speakers 1 and 21 in fully retracted, active modes. In each case, the unique shapes of the radial surround elements serve to drain water and debris and prevent and self-clean accumulation of water, dirt, and debris from speakers 1 and 21.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A radial dome speaker comprising:

an exterior upper speaker diaphragm positioned atop the speaker, said diaphragm having smooth, curved, exterior side wall surfaces which slope downwardly, terminating at bottom edges of the side wall, and an exterior lower speaker diaphragm having smooth, curved, exterior side wall surfaces having top edges and bottom edges, said top edges being adjacent to and bordering the bottom edges of the exterior side wall surfaces of the upper speaker diaphragm, wherein the exterior side wall surfaces of the upper and lower diaphragms form continuous, uninterrupted exterior speaker side wall surfaces which smoothly slope downward from the top of the exterior of the speaker to the bottom edges of the lower speaker diaphragm, the exterior side wall surfaces of the lower speaker diaphragm being sloped downwardly to a curved radial surround element, said exterior side wall surfaces of the lower speaker diaphragm being located between the exterior side wall surfaces of the upper speaker diaphragm and the radial surround element, the curved radial surround element being located below and completely circumscribing the bottom of the lower speaker diaphragm.

2. The radial dome speaker as in claim 1 wherein the upper and lower speaker diaphragms are dome shaped.

3. The radial dome speaker as in claim 1 wherein the radial surround element has smooth, curved "C" shaped outer surfaces which are vertically oriented and contiguous with the side wall surfaces of the lower speaker diaphragm.

4. The radial dome speaker as in claim 1 wherein the radial surround element has a curved convex shape and is located below the lower speaker diaphragm.

5. The radial dome speaker as in claim 4 wherein the radial surround element has a "U" shape.

6. The radial dome speaker as in claim 4 wherein the side wall surfaces of the lower speaker diaphragm terminates at a bottom edge.

7. The radial dome speaker as in claim 1 further comprising a voice coil positioned below the diaphragms, wherein when the speaker is in a static mode, water, dirt, and other debris flow downward off the side wall surfaces of the diaphragms, and completely off of the speaker, and in an active, sound producing mode, an electrical signal is supplied to the voice coil which translates vibrations to the diaphragms and radial surround element to energize dirt and debris on the diaphragms and radial surround element to cause dirt and debris to flow downward off said side wall surfaces and completely off the speaker.

* * * * *